US005169210A

United States Patent [19]

Fricano

[11] Patent Number: 5,169,210

[45] Date of Patent: Dec. 8, 1992

[54] CHAIR WITH PIVOTING KEYBOARD PAD

[75] Inventor: Nicholas J. Fricano, Grand Haven, Mich.

[73] Assignee: Haworth, Inc., Holland, Mich.

[21] Appl. No.: 534,456

[22] Filed: Jun. 7, 1990

[51] Int. Cl.[5] ..... A47C 7/62

[52] U.S. Cl. ..... 297/188; 297/170; 248/231.2

[58] Field of Search ..... 297/170, 188, 217, 135; 108/50, 147, 139, 141, 150, 152; 248/918-923, 205.2, 231.2, , 231.9, 188.5

[56] References Cited

U.S. PATENT DOCUMENTS

| | | | |
|---|---|---|---|
| 689,758 | 12/1901 | Shaw | 297/170 |
| 951,145 | 3/1910 | McGenniss | 297/170 |
| 993,493 | 5/1911 | Young | 297/170 |
| 2,661,049 | 12/1953 | Sebel | 108/50 |
| 2,755,845 | 7/1956 | Robin | 297/144 |
| 3,348,799 | 11/1965 | Junkel et al. | 108/141 |
| 3,393,649 | 7/1968 | Miotke | 108/141 |
| 3,601,443 | 8/1971 | Jones | 297/188 |
| 3,712,669 | 1/1973 | Cates | 297/188 |
| 4,330,776 | 5/1982 | Dennison, Jr. | 248/918 |
| 4,500,134 | 2/1985 | Kaneko et al. | 297/173 |
| 4,638,969 | 1/1987 | Brown | 248/919 |
| 4,645,167 | 2/1987 | Hardwick | 297/188 |
| 4,672,898 | 6/1987 | Davidson | 108/139 |
| 4,779,922 | 10/1988 | Cooper | 298/920 |
| 4,823,887 | 4/1989 | Umeda | 248/231.2 |
| 4,836,127 | 6/1989 | Willie | 248/231.9 |
| 4,911,389 | 3/1990 | Self | 248/205.3 |
| 4,925,240 | 5/1990 | Peter | 297/217 |
| 4,989,818 | 2/1991 | Trundle et al. | 248/231.9 |

*Primary Examiner*—Kenneth J. Dorner
*Assistant Examiner*—Cassandra Hope
*Attorney, Agent, or Firm*—Flynn, Thiel, Boutell & Tanis

[57] ABSTRACT

A chair having a support pad arrangement movably mounted thereon, with the support pad mounting on one side thereof an integrated or removable computer keyboard. In the preferred embodiment, when the pad is in a primary use position wherein it extends in front of the chair occupant, the pad can also be vertically rotated to cause the bottom surface thereof to face upwardly, which latter surface is substantially flat and can be used as a conventional support or writing surface.

1 Claim, 4 Drawing Sheets

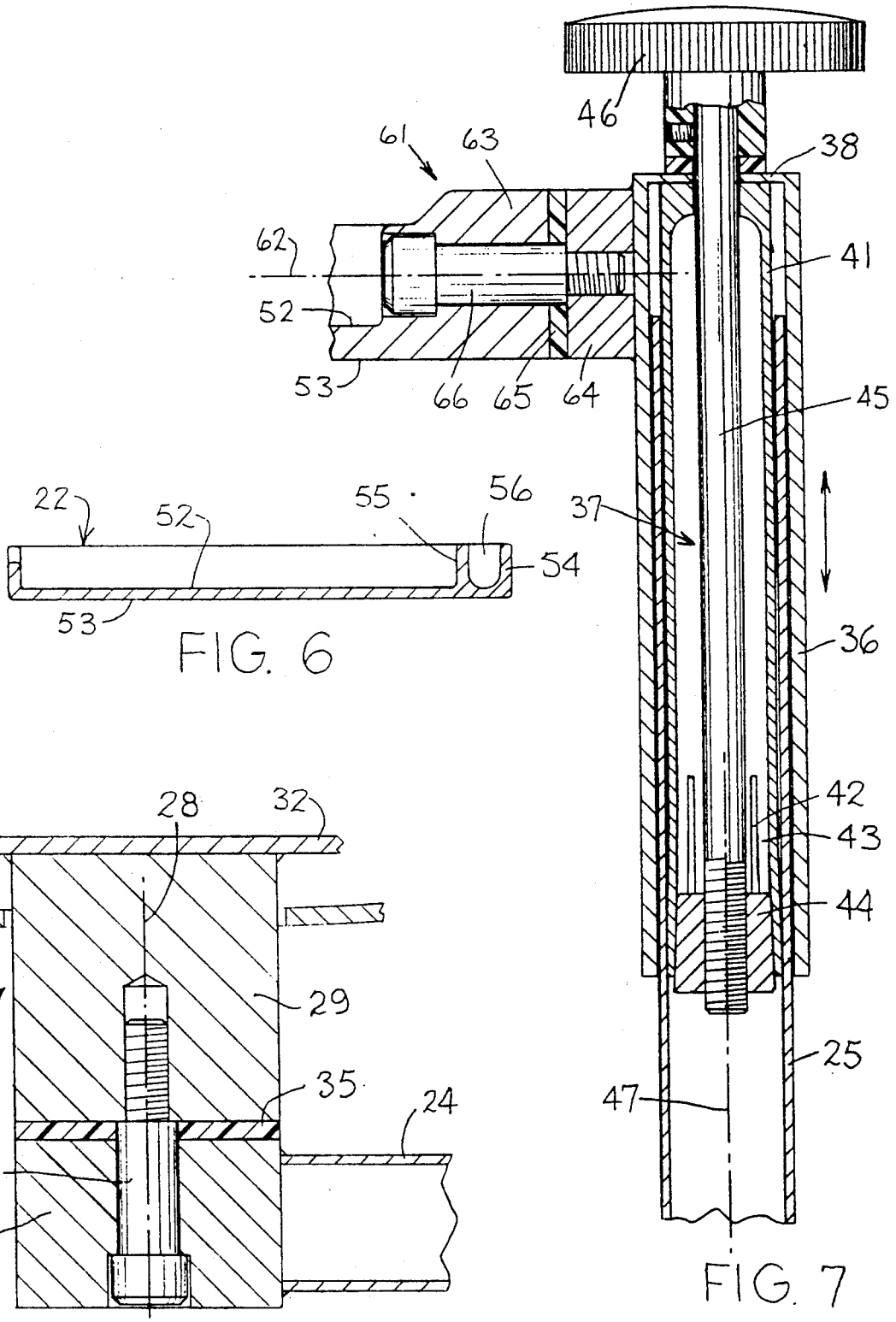
FIG. 6
FIG. 7
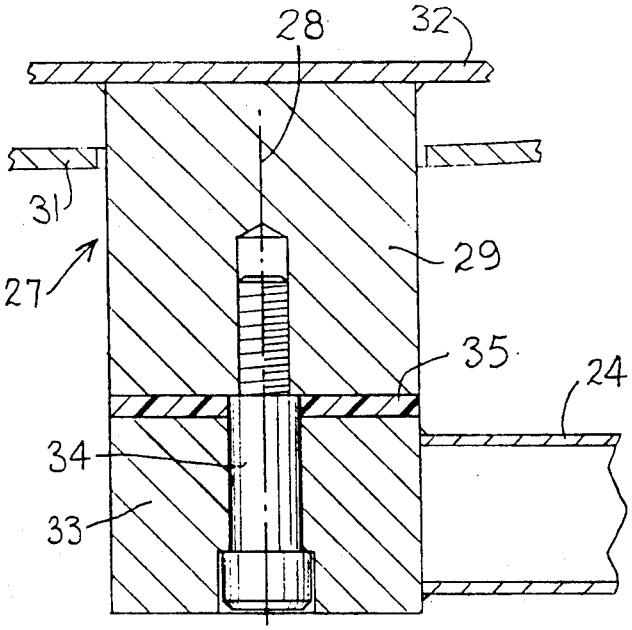
FIG. 8

CHAIR WITH PIVOTING KEYBOARD PAD

FIELD OF THE INVENTION

This invention relates to a chair having a support pad mounted thereon for movement between multiple use and storage positions, which pad preferably incorporates features which permit its use for supporting a keyboard of a computer.

BACKGROUND OF THE INVENTION

Numerous chairs have been developed and utilized which are provided with a support pad intended to be used as a flat writing or support surface. Many of the known chairs which mount thereon a support pad (often referred to as a tablet) also permit movement of the pad between use and storage positions. However, these known chairs typically have not permitted or facilitated use of the pad for supporting a computer keyboard. These known chairs have also normally not provided armrests on opposite sides of the seat, with the armrests being structurally and functionally independent of the support pad. Further, the known arrangements typically have provided single use and storage positions, and hence have not provided a high degree of flexibility with respect to both the use and storage of the pad.

Accordingly, the present invention relates to a chair having an improved support pad arrangement movably mounted on the chair, with the support pad defining on one side thereof a support structure designed particularly for supporting and securely retaining a computer keyboard. In the preferred embodiment, when the pad is in a primary use position wherein its extends generally in front of the chair occupant, the pad can also be vertically rotated so as to cause the normal bottom surface thereof to face upwardly, which latter surface is substantially flat and can be used as a conventional support or writing surface. In a variation of the invention, the keyboard can be integrated into the pad.

In the improved arrangement of this invention, the pad is mounted on an arm arrangement which is swingably supported from the chair to allow the pad to be swingably moved horizontally from a use position in front of the chair to a storage position located sidewardly of the chair, or possibly even rearwardly of the chair. The pad itself, when in the storage position, can be maintained generally horizontal or pivoted into a vertical storage orientation. Further, when in the storage position adjacent the side of the chair, the pad can be vertically rotated so that the flat surface faces upwardly for use in a manner similar to a conventional side tablet.

In addition, the improved arrangement of this invention permits the movable pad to be mounted on a chair having armrests disposed adjacent and spaced upwardly from opposite sides of the chair seat, which armrests can be utilized by the chair occupant both when the pad is stored and when the pad is in its primary use position disposed in front of the occupant. At the same time, the pad can be readily moved between the use and storage positions without interfering with the armrest. This thus provides for increased comfort of the chair occupant, and greater usability and flexibility with respect to overall use of the chair.

Other objects and purposes of the invention will be apparent to persons familiar with structures of this general type upon reading the following specification and inspecting the accompanying drawings.

BRIEF DESCRIPTION OF THE DRAWINGS

FIG. 6 is a sectional view along line 6—6 in FIG. 4.

FIG. 7 is an enlarged, fragmentary sectional view illustrating the structural connection of the support arm to the support pad.

FIG. 8 is an enlarged fragmentary sectional view illustrating the pivotal attachment of the lower end of the support arm to the underside of the chair seat.

Figure 1:
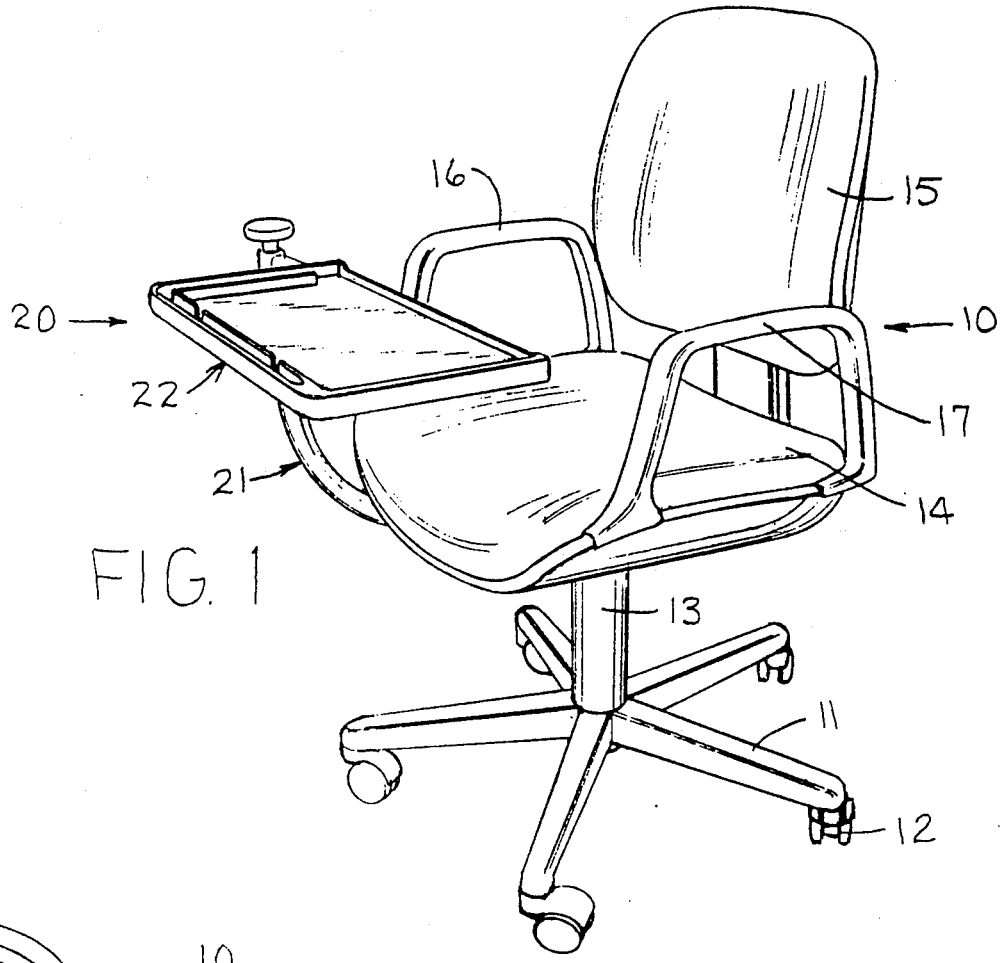
FIG. 1 is a perspective view of a chair mounting thereon the improved keyboard support pad arrangement of the present invention.

Certain terminology will be used in the following description for convenience in reference only, and will not be limiting. For example, the words "upwardly", "downwardly", "rightwardly" and "leftwardly" will refer to directions in the drawings to which reference is made. These same words will also be used to denote directions associated with and perceived by an occupant of the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
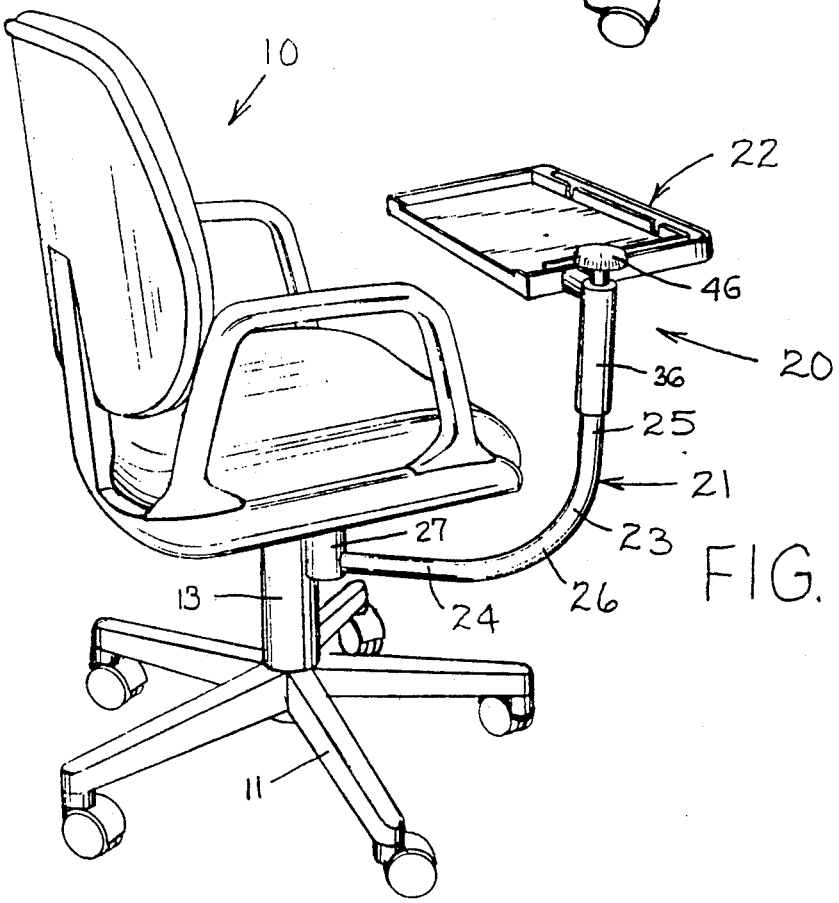
FIG. 2 is a perspective view similar to FIG. 1 but taken from a different angle.

Referring to FIGS. 1 and 2, there is illustrated a generally conventional chair 10 of the pedestal type. This chair 10 includes a conventional five-leg base 11, with each leg mounting a suitable support caster 12. A support pedestal 13 joins to the center of the base and projects upwardly therefrom and at its upper end is joined to the seat structure 14 substantially at the middle thereof. This upright pedestal 13 mounts therein a conventional height adjusting structure for permitting the seat structure 14 to be adjusted in height, and for also permitting swiveling of the seat relative to the base substantially about the vertical centerline of the pedestal. The seat structure 14 in turn joins to the back structure 15. The chair 10 also has right and left armrests 16 and 17, respectively which are fixedly related relative to the seat structure and are disposed in upwardly spaced relationship adjacent opposite sides thereof.

The structure of the chair 10 is conventional, and in fact the arrangement illustrated in the drawings has been chosen merely for convenience in illustration. It will be recognized that the overall structure and configuration of the chair may depart significantly from the chair illustrated in the drawings without departing from the present invention, as explained in greater detail below.

Accordingly to the present invention, the chair 10 mounts thereon a support pad assembly 20 which is designed particularly for permitting support of a computer keyboard. This support pad assembly 20 includes a support arm arrangement 21 which has its lower end pivotally mounted to the seat structure, and which at its upper end mounts a keyboard pad arrangement 22.

The support arm arrangement 21 includes a lower generally L-shaped arm member 23 which is normally bent from an elongate tubular member and includes a lower generally horizontally extending arm 24 joined to an upper and generally vertically extending arm 25, which arms 24 and 25 are joined by an intermediate bend 26.

Figure 3:
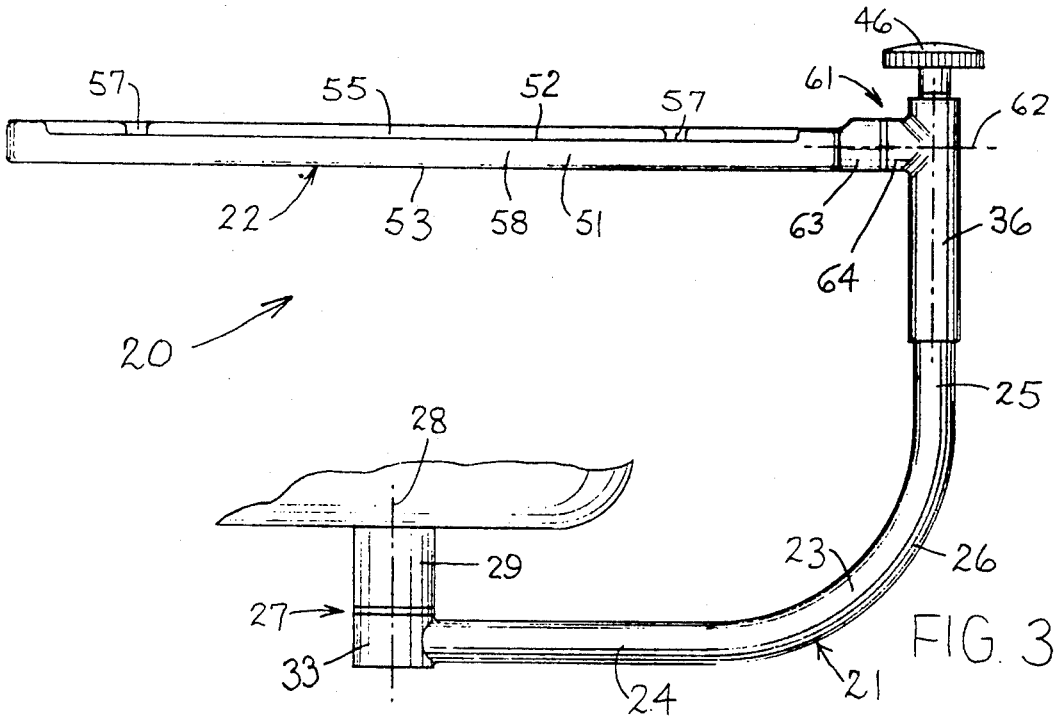
FIG. 3 is an elevational view of the support pad arrangement and its attachment to the underside of the chair seat.

As illustrated by FIG. 3, the lower free end of the arm member 23 is pivotally joined to the underside of the seat structure by a pivot-type mounting 27 which defines a generally vertically extending pivot axis 28. This pivotal mounting is positioned substantially at the center of the seat when viewed in the front-to-back direction, but is offset sidewardly from the central front-to-back vertical plane. The pivot mounting 27 is thus disposed in sidewardly spaced relationship from the upright pedestal 13 so that the pivot axis 28 is generally parallel with but sidewardly spaced from the swivel axis defined by the upright 13. In the illustrated embodiment, this pivot mounting 27 is secured to the right side of the seat structure inasmuch as most individuals are right-handed, although the assembly 21 could obviously be mounted on the left side of the chair if desired.

The pivot mount 27 includes a support 29 which, in the embodiment as illustrated by FIGS. 3 and 8, is a hub member which projects upwardly through the bottom shell 31 of the chair for fixed securement to a load bearing member 32 positioned interiorly of the chair seat, which member 32 is typically a part of a conventional chair control. It will be appreciated, however, that the support 29 may attach to any desired and available load bearing member associated with the seat structure.

The pivot mount 27 also includes a cooperating mounting part 33 which is fixed to the free end of the horizontal arm 24. A suitable fastener 34, which also effectively functions as a hinge pin, joins the support 29 and part 33 together so as to permit relative pivotal movement about the vertical hinge axis 28. A suitable washer, such as a plastic (e.g. nylon) washer 35, is interposed between support 29 and part 33 to facilitate pivoting while at the same time providing sufficient friction so as to permit the arm to stably remain in a selected position.

The support arm arrangement 21 also includes a top support member 36 which is formed as a vertically elongate tube and is vertically slidably telescoped over the upper end of the vertical arm 25. The top tube 36 can be vertically adjusted relative to the vertical arm 25, and then locked in position by a suitable securing mechanism 37, to enable the height of the support arm arrangement 21 to be adjusted.

As illustrated by FIG. 7, the upper end of the top tube 36 is substantially closed by a transversely extending end wall 38, and the securing mechanism 37 projects generally downwardly therefrom for disposition within the interior of the vertical arm 25.

The securing mechanism 37 includes an elongate tubular clamping sleeve 41 which is normally disposed with its upper end abutting against the top wall 38, and the sleeve 41 projects downwardly so as to be received in close proximity within the interior of the vertical arm 25. The lower end of clamping sleeve 41 has several slits 42 extending axially upwardly from the free end thereof in circumferentially spaced relationship therearound. These slits define resilient cantilevered clamping fingers 43 at the lower end of the clamping sleeve. The securing mechanism 37 also includes an actuating wedge 44 which wedgingly cooperates with the resilient clamping fingers 43. This wedge 44 has a key (not shown) which projects into one or more of the slots 42 so as to prevent rotation of the wedge 44 and limit upward travel thereof. The wedge 44 has an outer peripheral surface which is generally cylindrical but provided with a slight converging taper as it projects upwardly. The interior of this wedging sleeve 44 is threadedly engaged with the lower end of actuating rod 45 which projects coaxially upwardly through the top wall 38 of the top tube 36 and is provided with a gripping knob 46 nonrotatably secured thereto. Rotation of knob 46 and shaft 45 causes the wedging sleeve 44 to move upwardly or downwardly depending upon the direction of rotation, thereby permitting either expansion or contraction of the resilient clamping fingers 43 to enable the clamping sleeve to respectively grip or release the vertical tube 25. With this arrangement, the top tube 36 can be vertically adjusted in height by as much as several inches relative to the top arm 25.

The top tube 36 and the pad arrangement 22 carried thereby can be horizontally pivoted generally about the central axis 47 of the top tube 25.

Considering now the pad arrangement 22, it includes a pad member 51 which is of a generally enlarged and rectangular platelike construction. This platelike pad member 51 defines on opposite sides thereof enlarged and generally parallel support surfaces 52 and 53. When the pad member 51 is oriented for supporting a computer keyboard, then the support surface 52 is oriented so as to face generally upwardly to permit disposition of a keyboard thereon. To securely retain the keyboard on the surface 52, the pad 51 is provided with a generally endless looplike peripheral rim or flange 54 which extends around the peripheral edge of the pad member 51 and projects slightly upwardly above the plane of the keyboard support surface 52. The presence of this peripheral flange 54 cooperates with the surface 52 so as to define a shallow upwardly-facing recess or well for confinement of the computer keyboard therein.

To further assist in securement of the keyboard on the pad member 51, there is preferably additionally provided releasable securing structure such as velcro strips 59 secured to the surface 52, which strips cooperate with additional strips (not shown) secured to the underside of the keyboard.

To facilitate storing of the keyboard on the pad member 51 when it is disconnected from the computer, the pad member 51 is also preferably provided with an additional guide flange 55 which is generally L-shaped in plan view and which projects upwardly a limited extent from the surface 52. This guide flange 55 has a first elongate leg thereof positioned closely adjacent and spaced slightly rearwardly from the front portion of the peripheral rim 54, and guide flange 55 also has a side leg which projects rearwardly and is positioned closely adjacent the right side of the peripheral rim 54. The peripheral rim 54 and guide flange 55 cooperate to define a shallow, upwardly opening, generally L-shaped groove 56 therebetween which can be utilized for storing the cable which connects to the keyboard. The guide flange 55 also has a pair of transversely extending notches or cutouts 57 for permitting the cord as attached to the keyboard to pass from the main keyboard storage well through one of the cutouts 57 into the storage groove 56.

The peripheral edge flange 54 on the side of the pad facing the user, namely the rearward side when surface 52 is oriented upwardly, is also preferably of less height, such as indicated at 58 in FIG. 3, to provide increase access to the keyboard.

As to the opposite side of the pad 51, namely the surface 53, this is generally a smooth and hard planar surface so as to be usable as a supporting or writing surface when the pad 51 is oriented so that the surface 53 faces generally upwardly.

To permit the pad member 51 to be positioned with either surface 52 or 53 facing upwardly, or to permit slight adjustment in the angular orientation of the selected surface for user convenience, the pad member 51 is connected at one side edge thereof through a pivot mount 61 to the upper end portion of the top tube member 36. This pivot mount 61 permits the pad member 51 to be mounted on and project in a cantilevered manner away from the upper end of the support arm arrangement 21, while at the same time enables the pad 51 to be vertically pivotally displaced about a generally horizontally extending pivot axis 62 as defined by the pivot mount 61.

The pivot mount 61, as illustrated by FIG. 7, includes a generally cylindrical hublike mounting part 63 which is fixedly secured to and projects sidewardly away from one edge of the pad 51. This hublike connecting part 63 cooperates with a further hublike connecting part 64 which is fixed to and projects sidewardly from the upper end of the top support tube 36. A suitable washer 65, of plastic (e.g. nylon), is interposed between the connecting parts, and a fastening element 66 axially securely joins the connecting parts 63 and 64 together while at the same time the fastening element 66 functions as a hinge pin for enabling the pad 51 to be vertically pivoted about the pivot axis 62 defined by the fastener 66. The pivot mount 61, and the use of the washer 65, is such as to provide a frictiontype brake which will permit the pad 51 to remain in a selected angular position, but which will permit the pad to be angularly displaced when suitably gripped and rotated.

Figure 4:
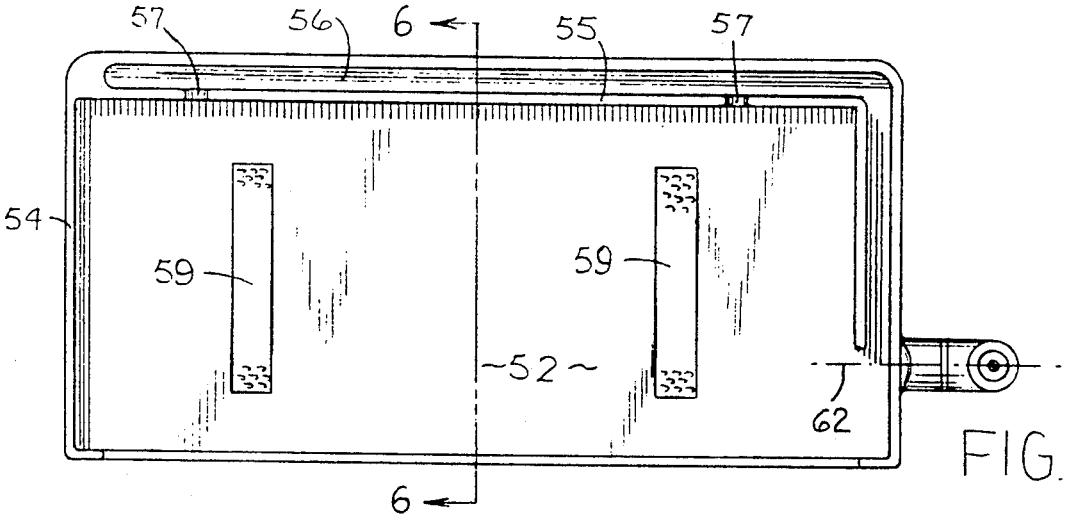
FIG. 4 is a top view showing the support pad with the keyboard support surface disposed uppermost.
Figure 5:
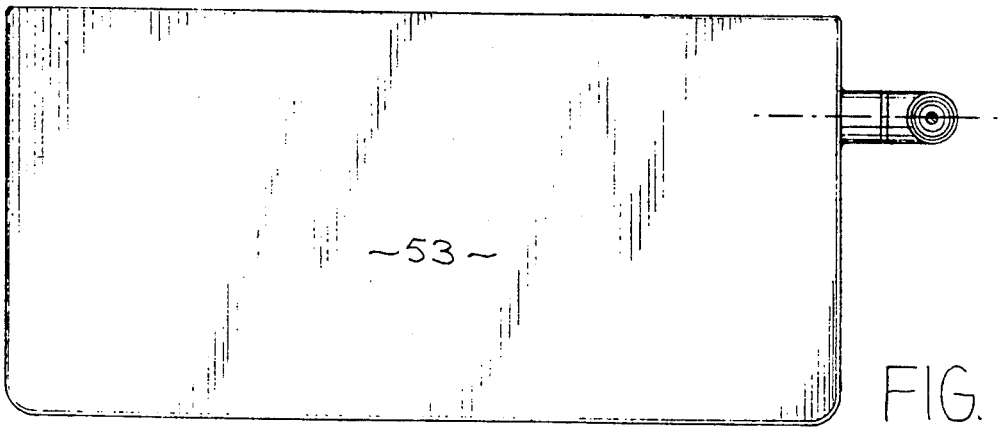
FIG. 5 is a top view similar to FIG. 4 but showing the pad vertically rotated approximately 180° so that the flat working surface is uppermost.

In the illustrated embodiment, and particularly as illustrated by FIGS. 4 and 5, the horizontal pivot axis 62 extends generally in the lengthwise or elongated direction of the pad 51 but is positioned more closely adjacent one of the longitudinally extending front and rear edges thereof. This permits the pad to be spaced a slightly greater distance away from the occupant of the chair when the pad is oriented with surface 52 upwardly for supporting a keyboard thereon, whereas when the pad is oriented with surface 53 upwardly for use as a writing surface, the pad is positioned somewhat closer to the chair occupant for the convenience of the user. This also provides more leg clearance space when the pad is rotated between these positions.

When it is desired to utilize the chair 10 having the support pad assembly 20 thereon for supporting a computer keyboard, then the pad 51 is oriented generally horizontally so that the surface 52 faces upwardly, whereupon a keyboard (not shown) can be positioned in the shallow well surrounded by the peripheral flange 54 and, if necessary, secured by the velcro strips 59. The cord from the keyboard will then be connected to the computer (not shown).

Figure 9:
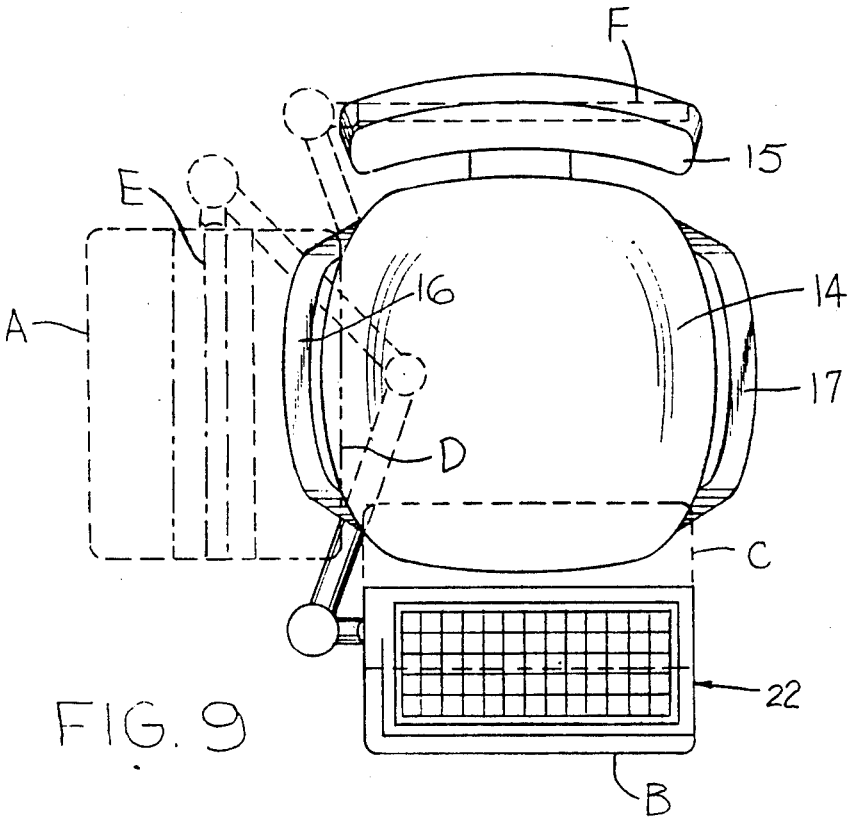
FIG. 9 is a top view of the chair showing many of the different positions of the support pad arrangement relative to the chair.

During normal usage, after the user is seated in the chair, then the arm arrangement 21 is swung forwardly about the pivot axis 28 so that the pad is positioned generally in front of the user substantially as illustrated by the solid line position B in FIG. 9. The user can selectively adjust the height of the pad by rotating knob 46 to loosen the securing mechanism 37, following which the pad can be selectively raised and lowered as permitted by the telescopic movement of the top support tube 36 relative to the vertical tube 25. Knob 46 is then again rotated to tighten the securing mechanism 37 and hence lock the pad 51 at the selected height. Even after the securing mechanism 37 has been locked, the pad 51 can be rotated about the axis 47 of the upright tube 25 since the top tube member 36 is freely rotatably supported on the top tube 25. The user can also angularly displace the pad 51 about the axis 62 so as to provide the optimum angle for user comfort and use.

When the user wishes to exit the chair or store the computer keyboard, then the complete support pad assembly 20 is manually swung sidewardly about the bottom hinge axis 28 so as to cause the arm to swing through an angle of about 90 to position the arm adjacent the rear corner of the chair, which in turn results in the pad 51 being positioned adjacent and slightly outwardly from the right armrest 16, substantially as illustrated by the dotted line position A in FIG. 9.

If usage of the keyboard is not desired, or if the keyboard is removed from the pad, then the support pad assembly 21 provides additional use or storage options. For example, when the pad is positioned in front of the chair occupant, it can be rotated about the horizontal pivot axis 62 through an angle of about 180 so that the flat surface 53 of the pad faces upwardly, with the pad being positioned approximately as indicated by the dotted line position C in FIG. 9. In this position the user can utilize the surface 53 as a support or writing surface. Further, in this position the surface 53 is positioned somewhat closer to the user to facilitate its use as a writing surface.

Alternatively, the pad support mechanism 20 can be swung sidewardly from position C so that the pad, with the surface 53 facing upwardly is disposed generally at the position D of FIG. 9 as indicated by the dashdouble dot line. In this sideward position D, the keypad with surface 53 facing upwardly is disposed adjacent one side of the chair, and the support pad 51 projects inwardly so as to overlie the right armrest 16. Hence, the user or chair occupant can now utilize the upwardly facing surface 53 on the pad as a support or writing surface in a manner similar to a conventional side tablet arm chair.

As alternative storage positions, the pad 51 can be rotated about axis 62 so that the pad is suspended generally vertically downwardly (i.e., surfaces 52 and 53 will be generally vertical). In this downwardly suspended position, the pad can be stored outwardly from but closely adjacent one side of the chair, substantially as illustrated by the single dot-dash line position E shown in FIG. 9. Still further, when the pad is in this vertically suspended position, the arm can be swung further manually rearwardly of the chair, and the entire pad rotated about the axis 47 so that the pad can be stored directly behind the chair substantially as illustrated by dotted line position F in FIG. 9.

While not illustrated, it will be appreciated that the pivot mount 61 can be provided with a stop arrangement cooperating between the connecting parts 63 and 64, if desired, for limiting the angular displacement of the pad 51 about the axis 62. For example, one of connecting parts 63 and 64 can be provided with a stop pin projecting axially therefrom and engaged within an arcuate groove formed in the other connecting part. Such groove would be sized to permit approximately 180° of angular displacement of the pad so that the stop pin bottoms out when the surface 53 is horizontal and facing upwardly to provide a secure holding of the surface, but which permits the pad to be angularly rotated upwardly from the position of FIG. 5 through an angle of about 180 to assume the keyboard support position shown by FIG. 4, with the other end of the stop bottoming out when the surface 52 is facing upwardly and horizontal. This arrangement, however, still permits the pad 51, when disposed with surface 52 facing upwardly, to be slightly inclined toward the user so as to optimize user comfort and accessibility to the keyboard. In order to permit storage of the pad in a vertical suspended position (position E in FIG. 9), the groove would be sized to permit about 270° of angular displacement and hence the stop pin would not bottom out when the surface 52 faces upwardly.

The securing mechanism 37 as described above represents one structure for adjustably vertically locking the posts 25 and 36, and it will be recognized that other known mechanisms are suitable for performing this function.

Figure 10:
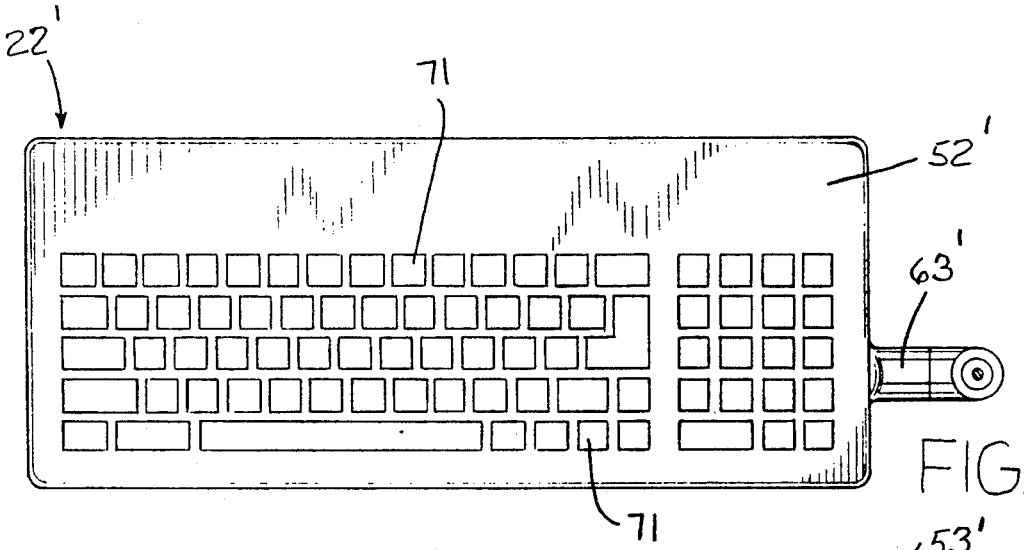
FIGS. 10 and 11 are views which respectively correspond to FIGS. 4 and 5 but which illustrate a variation wherein the keyboard is integrated into the pad.
Figure 11:
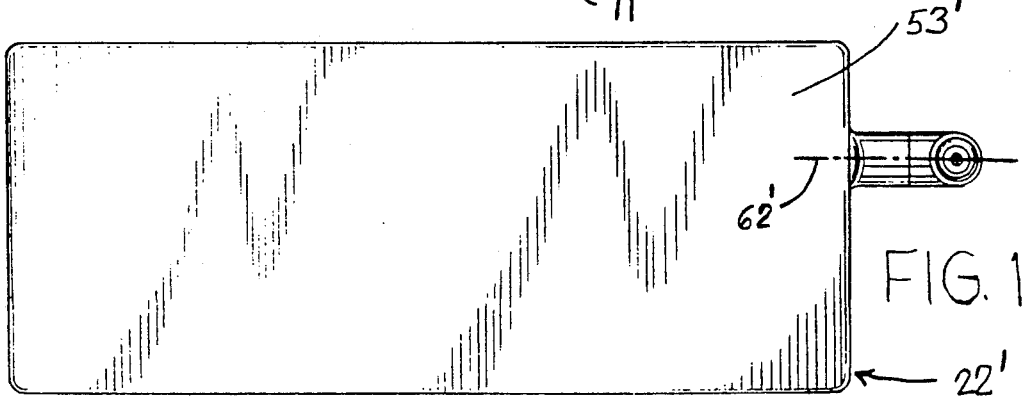

Referring now to FIGS. 10 and 11, there is illustrated a variation of the keyboard pad arrangement 22'. In this variation, the keyboard pad arrangement 22' has a computer keyboard unit integrated therein between the normally upper and lower surfaces 52' and 53'. The keyboard unit includes accessible keys or key pads 71 which are associated with and normally project upwardly from the upper surface 52'. The structure of the keyboard unit, which is generally conventional, is disposed interiorly between the upper and lower surfaces 52' and 53', respectively. The bottom surface 53' is again formed as a generally enlarged planar surface so as to function as a writing surface when the keyboard support pad arrangement 22' is rotated about the axis 62' so as to face upwardly. The hublike connecting part 63' projects outwardly from and is formed as an integral part of the housing associated with the pad arrangement 22'.

Hence, this keyboard support pad arrangement 22' structurally and functionally cooperates in the same manner as the keyboard support pad arrangement 22 except that the keyboard is integrated into and constitutes an overall unitized part of the pad arrangement 22', rather than utilizing a separate keyboard as in the case of the keyboard support pad arrangement 22.

Further, with respect to both variations of the invention, the keyboard can be connected to the computer via a conventional cable if desired, or in the alternative the keyboard can be connected to the computer using new connecting technology, such as an infrared connection.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a base supported on casters for rolling movement, an upright elongated pedestal extending upwardly from said base, a seat structure mounted on said pedestal for swiveling movement about a vertical centerline of said pedestal, said seat structure having a front edge, a rear edge, two opposed side edges, an upper surface and a lower surface, and an upright back structure extending upwardly from said seat structure close to the rear edge thereof, the improvement which comprises:

a substantially L-shaped support structure comprising (1) a lower, elongated, substantially horizontal arm having an inner end located below said seat structure and having an outer end extending beyond one of the side edges of said seat structure, and (2) an upper, elongated, substantially upright arm extending upwardly from said outer end of said horizontal arm and extending alongside said seat structure to a location above said seat structure, a first pivot mounting on the lower side of said seat structure and providing a first vertical pivot axis below said seat structure, the inner end of said horizontal arm being mounted on said first pivot mounting for pivotal movement about said first vertical pivot axis, said first vertical pivot axis being laterally offset from the vertical centerline of said pedestal, a vertical, elongated, first tube sleeved on an upper end portion of said upright arm for vertical sliding movement thereon and for pivotal movement about a longitudinal axis of said upright arm, means for releasably locking said first tube against vertical sliding movement and against pivotal movement with respect to said upright arm, a second pivot mount extending sidewardly from said first tube close to an upper end thereof and providing a horizontal pivot axis extending at a right angle to said upright arm at the upper end thereof, an enlarged pad member of substantially rectangular platelike configuration and having support surfaces on opposite sides thereof, one of said support surfaces having means for supporting a computer keyboard thereon and the other of said support surfaces being substantially planar so that it can be used as a writing surface, said pad member being supported on said second pivot mount for pivotal movement about said horizontal pivot axis between a first position in which one of said support surfaces faces upwardly and a second position in which the other of said support surfaces faces upwardly, said pad member being supported in centilevered fashion relative to said upright arm so that it can extend crosswise of said seat structure, said substantially L-shaped support structure being a second tube and said means for releasably locking said first tube against vertical sliding movement and against pivotal movement with respect to said upright arm comprising a tubular clamping sleeve vertically slidably disposed within the upper end portion of said upper arm, said tubular clamping sleeve having circumferentially spacedapart resilient clamping fingers at its inner end inside said upper arm and frictionally engageable with an inner surface of said upper arm, a vertically movable wedge member engageable with said clamping fingers for moving same outwardly into frictional engagement with the inner surface of said upper arm and a manually operable screw for moving said wedge member into and out of engagement with said clamping fingers.

* * * * *